US007128664B2

(12) United States Patent
Onoda et al.

(10) Patent No.: US 7,128,664 B2
(45) Date of Patent: Oct. 31, 2006

(54) GOLF CLUB HEAD AND MANUFACTURING METHOD THEREOF

(75) Inventors: Kenji Onoda, Osaka (JP); Katsuyuki Aizawa, Gifu (JP); Hsiu Hao Chuang, Tashu (TW)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/727,079

(22) Filed: Dec. 2, 2003

(65) Prior Publication Data

US 2005/0119068 A1 Jun. 2, 2005

(30) Foreign Application Priority Data

Dec. 2, 2002 (JP) ..... 2002-349443

(51) Int. Cl.
*A63B 53/04* (2006.01)

(52) U.S. Cl. ..... 473/347; 473/345

(58) Field of Classification Search ..... 473/324–350
See application file for complete search history.

(56) References Cited

U.S. PATENT DOCUMENTS 4,635,941 A * 1/1987 Yoneyama ..... 473/331
4,664,383 A * 5/1987 Aizawa ..... 473/329
4,754,975 A * 7/1988 Aizawa ..... 473/348
5,405,137 A * 4/1995 Vincent et al. ..... 473/342
5,624,331 A * 4/1997 Lo et al. ..... 473/345
6,875,126 B1 * 4/2005 Yabu ..... 473/305
6,969,326 B1 * 11/2005 De Shiell et al. ..... 473/345
7,022,032 B1 * 4/2006 Chen ..... 473/346

* cited by examiner

*Primary Examiner*—Eugene Kim
*Assistant Examiner*—Alvin A. Hunter, Jr.
(74) *Attorney, Agent, or Firm*—Troutman Sanders LLP; Gerald R. Boss; James Hunt Yancey, Jr.

(57) ABSTRACT

The present invention intends to prevent deviation and gap from being generated in a joining section of a golf club in which a head main body 10A and a surface material 10B are integrated by joining together and provide a high quality golf club head having an improved durability and manufacturing method thereof. In the golf club head in which the head main body 10A and the surface material 10B are joined together such that they are integral, a groove 18 is provided in a joining section between the both members and joint material 19 composed of fiber reinforced resin material is embedded in that groove. Consequently, the joining strength is intensified.

10 Claims, 17 Drawing Sheets

(a)

(b)

GOLF CLUB HEAD AND MANUFACTURING METHOD THEREOF

PRIORITY CLAIM

This application claims the benefit of priority to the Japanese Application No. 2002-349443.

BACKGROUND OF THE INVENTION

1. Field of the Invention

The present invention relates to a golf club head in which a head main body and a surface material are integrated by bonding together and a manufacturing method thereof. Meanwhile, the "head main body" mentioned in this specification and the scope of claim for a patent refers to a section which to be is integrated with a golf shaft and has a face section, the head main body being formed integrally of metallic material or fiber reinforced resin material. The "surface material" refers to a member which forms the surface of a section in which the golf club head is located while it is integrated with this head main body, this surface material constructing a crown part or a back side face and being formed of metallic material or fiber reinforced resin material.

2. Description of the Related Art

Conventionally, golf club heads in which the head main body and the surface material are integrated by bonding together and a manufacturing method of such golf club head have been proposed.

For example, according to a patent document 1, in a golf club head comprised of a club face, a crown section, a sole section, a rear section, a neck section and the like, the club face, the central portion of the sole section, the central portion of the rear section and both portions of the crown section are formed of a single metallic reinforced plate as the head main body, while the surface material is formed of carbon fiber reinforced composite resin material for the other sections, and both the members are bonded together along their border peripheries with adhesive agent.

According to the patent document 2, a main body is cast with a mold in which a strike face plate is provided and a shaft fixing base is extended from an end of this strike face plate while a concave section is formed on an opposite side to the strike face of the strike face plate. After the angle of the shaft fixing base is adjusted by trimming, an engagement hole is made by tapping a bottom section of the main body. Next, the main body is subjected to heat treatment and polishing treatment. The periphery of the concave section in the main body is sand-blasted with alumina into rough phase. After that, a cover section made of carbon fiber reinforcing agent of multiple layers and having a hole for weight is joined with the concave section and a weight is engaged with the hole for weight so as to obtain a golf club head. Then, this golf club head is placed within a mold and an air bag is taken into the golf club head through the engagement hole and the air bag is filled with gas until the cover section makes a contact with a cavity in the mold and the golf club head is left to harden by hot pressing. After that, the air bag is taken out. Then, a filler block is engaged with the engagement hole.

Further, this inventor has proposed through Japanese Patent No.2002-244725, a manufacturing method of golf club head which comprises a hosel section, a face section, a crown section, a side section and a sole section while a head shell hallow inside is comprised of a first outer shell made of metallic material and a second outer shell made of fiber reinforced resin material, the manufacturing method comprising: a step of forming the outer shell of metallic material having the hosel section, face section and sole section, a step of obtaining an outer shell preparatory formed body by attaching a prepreg sheet in which the reinforced fibers are impregnated with thermosetting resin, a step of overlaying the prepregs in which the reinforced fibers are impregnated with thermosetting resin at positions corresponding to the crown section, side section and sole section of a head forming core material and taking out that core material so as to obtain the outer shell main body preparatory formed body comprised of the crown section, side section and sole section, a step of obtaining a head preparatory formed body by combining the outer shell preparatory formed body with the outer shell main body preparatory formed body and disposing a tube member within a hallow section in the head preparatory formed body through a hole in the hosel section and a step of placing the head preparatory formed body in a mold, closing the mold and heating the head preparatory formed body in the mold by filling the tube member with gas and applying pressure so as to obtain a head formed body.

As disclosed in the above-mentioned conventional arts, generally, to join the head main body and the surface material together, both the members are formed separately and joined together with adhesive agent applied to the joining sections of the both members or a preliminarily formed metallic material member is disposed within a golf club head forming mold and resin material for the surface material is hardened and formed integrally with the metallic material member.

After the joining of the both members is completed, burr formed by hardening of excess adhesive agent at the time of joining with the adhesive agent or excess resin at the time of the integral forming is removed and gaps generated in the hardened adhesive agent or resin are filled with putty. After polishing and painting, a golf club head is completed.

Patent document 1: Japanese Utility Model Application Laid-Open No. HEI 7-406

Patent document 2: Japanese Patent Application Laid-Open No. 2001-340499

However the golf club heads produced by joining the head main body and the surface material according to the above-mentioned conventional arts have following problems.

Because the golf club head is used for striking a ball repeatedly, vibration due to impact by the striking is generated entirely in the golf club head each time it hits the ball. Thus, because in a golf club head in which the head main body and the surface material are integrated, the properties of both the members are different, differences in transmission of vibration by such impact and the amount of deformation in material due to the impact are generated. Consequently, deviation or gap is generated in the joining section between the both members, thereby finally leading to destruction of the golf club head, which is a problem to be solved.

Further, in a golf club head constructed by joining the both members together with adhesive agent, the durability can be improved by intensifying the coupling force of the both members by enlarging the bonding area of the joining section or using strong adhesive agent. In a golf club head constructed by integral forming of the both members also, the durability can be improved by intensifying the coupling force of the both members by using a formation use adhesive agent having an excellent fitting performance to metallic material.

However, although in the golf club heads whose durability is improved, the coupling force can be intensified for the improvement of the durability, it is difficult to eliminate completely slight deformation in material and deviation and gap due to vibration on the border between the both members. Further, a crevice is generated in a coating film applied across the border on the joining section accompanied by the deviation or gap which may be generated when a ball is hit repeatedly with the golf club head finally finished by coating. For this reason, customer complaints occur and its specified quality cannot be maintained, which is a problem to be solved.

SUMMARY OF THE INVENTION

In views of the above-described problems, an object of the present invention is to prevent deviation and gap from being generated in a joining section of a golf club in which a head main body and a surface material are integrated by joining together and provide a high quality golf club head having an improved durability and manufacturing method thereof.

To achieve the above object, according to a first aspect of the present invention, there is provided a golf club head comprised of a head main body to be integrated with a golf shaft and a surface material to be integrated with the head main body, wherein a groove is provided in at least part of a joining section between the both said head main body and surface material and joint material composed of fiber reinforced resin material is embedded in the groove.

The head main body mentioned here refers to a section which is to be integrated with the golf shaft as described previously and has a face section 2 like a face/sole integrated part 11 shown in FIG. 2 and composed of metallic material such as titan, stainless steel, aluminum or fiber reinforced resin material. The surface material refers to a member which is integrated with the head main body and covers or forms the surface of a section in which the golf club head is located, for example, the crown part 12 shown in FIG. 2 or FIG. 8 or the bottom face of the head main body shown in FIG. 10 and formed of metallic material such as titan, stainless steel, aluminum or fiber reinforced resin material.

Although the "groove" mentioned in the first aspect of the invention may be formed to spread toward the outer surface of the golf club head in terms of its lateral section in the second aspect, the present invention is not restricted but the lateral sectional shape may be formed, for example, into a U-shaped or square configuration. That is, the "groove" mentioned in the first aspect may be of any shape as long as it can be filled with joint material composed of fiber reinforced resin material.

According to a second aspect of the present invention, there is provided the golf club head according to the first aspect wherein the groove is formed so as to spread in sectional view thereof toward the outer surface of the gold club head.

According to a third aspect of the present invention, there is provided the golf club head according to the first or second aspect wherein the orientation angle of the reinforced fiber of the joint material intersects a joint border line in the joining section.

According to a fourth aspect of the present invention, there is provided a manufacturing method of golf club head comprised of a head main body to be integrated with a golf shaft and a surface material to be integrated with the head main body, comprising steps of: providing a groove in at least part of a joining section between both the head main body and surface material; disposing the joint material composed of fiber reinforced resin material in the groove; and pressurizing the joint material by a pressurizing means.

According to a fifth aspect of the present invention, for example, as shown in FIG. 13 or, FIGS. 17(*a*) or 17(*b*), there is provided the manufacturing method of golf club head according to the fourth aspect wherein the step of disposing the joint material is a step of winding the joint material formed into a tape-like configuration.

According to a sixth aspect of the present invention, there is provided the manufacturing method of golf club head according to the fourth or fifth aspect wherein the pressurizing means is winding of the wrapping tape.

According to a seventh aspect of the present invention, there is provided a manufacturing method of golf club head comprised of a head main body to be integrated with a golf shaft and a surface material to be integrated with the head main body, the manufacturing method comprising steps of: providing a groove along an entire outer periphery of a joining section between both said head main body and surface material such that the lateral section spreads toward the outer surface of the golf club head; applying heat curing type adhesive agent to the groove; winding a joint material made of heat curing type fiber reinforced resin material formed in a tape-like configuration on the adhesive agent; and pressing the joint material.

DESCRIPTION OF THE PREFERRED EMBODIMENTS

Figure 1:
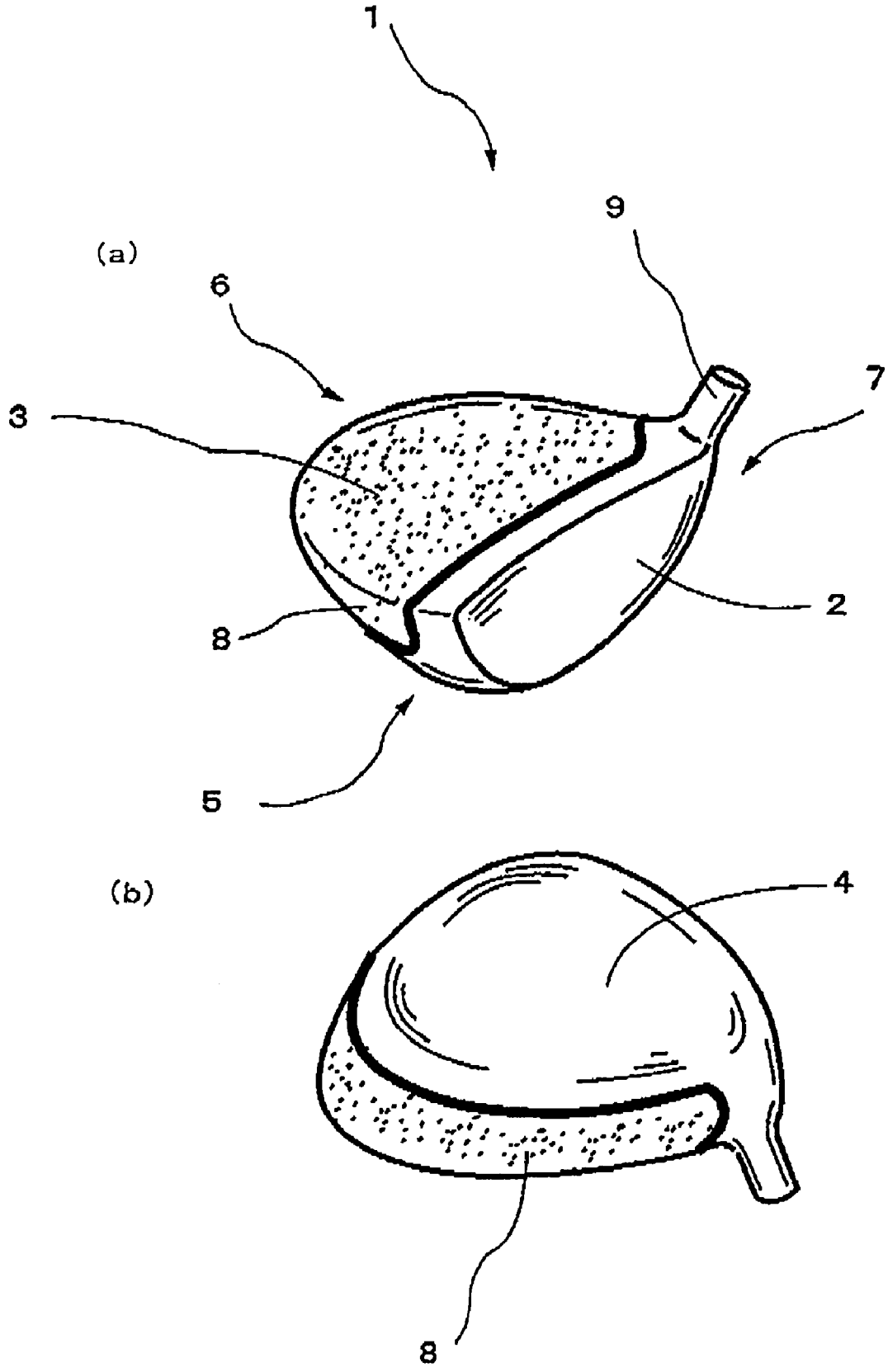
FIG. 1 is a perspective view of a golf club head according to an embodiment of the present invention.

Hereinafter, the preferred embodiment of the present invention will be described with reference to the accompanying drawings. FIG. 1 is a perspective view of a golf club head according to the embodiment of the present invention, FIG. 2 is a disassembly perspective view thereof, FIG. 3 is a lateral sectional view and FIG. 4 is an enlarged view of major sections of the present invention.

As shown in FIGS. 1(*a*) and (*b*), the golf club head 1 of the present invention comprises a face section 2 used for striking a golf ball, a crown section 3 which constitutes a top face of the gold club head 1, a sole section 4 which constitutes the bottom face of the golf club head 1, a side section 8 which is extended from a toe side 5 to a heel side 7 via a back side 6 between the crown section 3 and the sole section 4 and a hosel section 9 on which a golf shaft is mounted. The face section 2, the sole section 4 and the hosel section 9 constitute the head main body 10A mentioned in the present invention and the crown section 3 and the side section 8 constitute the surface material 10B mentioned in the present invention.

Figure 2:
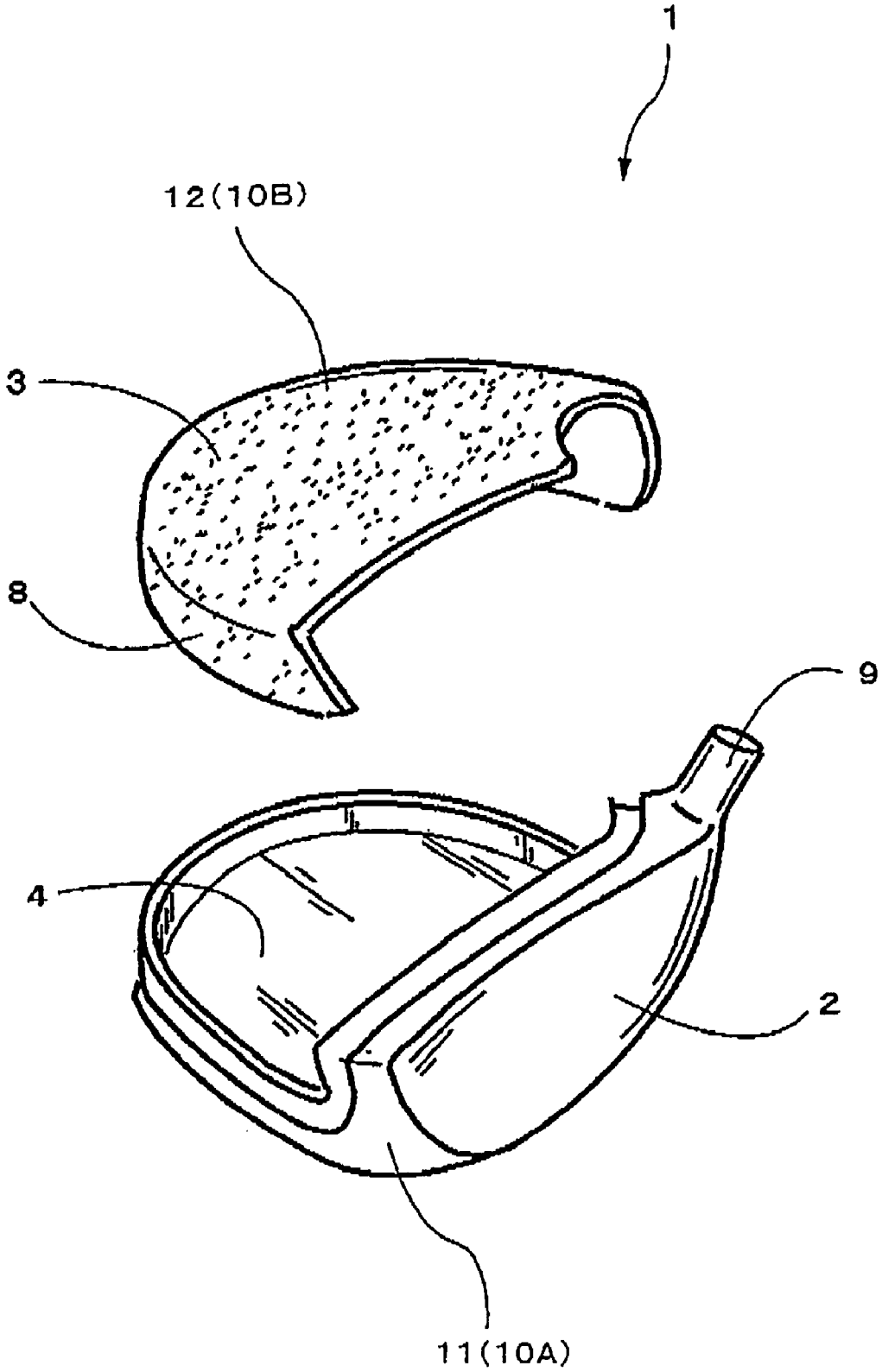
FIG. 2 is a disassembly perspective view of the golf club head according to the embodiment of the present invention.
Figure 3:
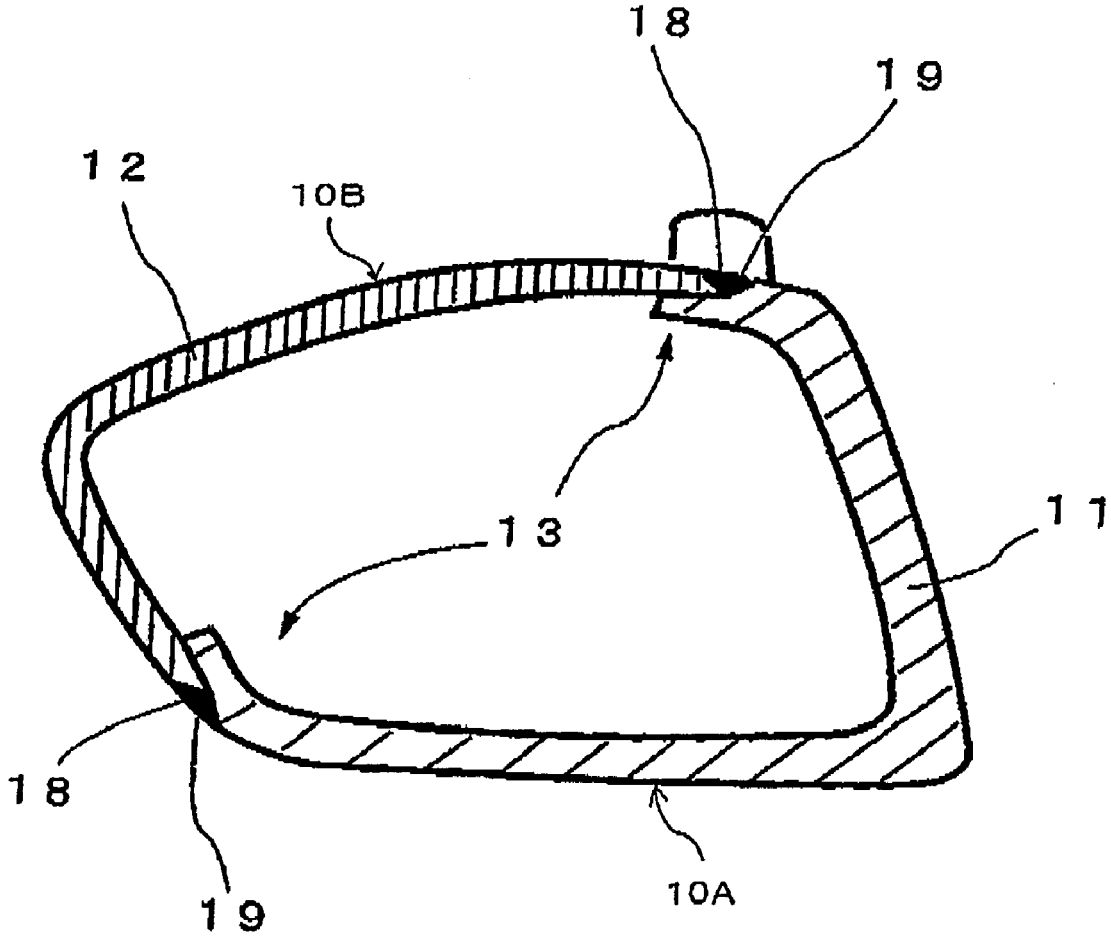
FIG. 3 is a lateral sectional view of the golf club head according to the embodiment of the present invention.

The golf club head 1 of this embodiment is produced by integrating a head main body 10A and a surface material 10B by bonding together and more specifically, as shown in FIGS. 2, 3, the golf club head 1 is comprised of a face/sole integrated part 11, which is the head main body 10A made of metallic material and a crown part 12, which is the surface material 10B made of fiber reinforced resin material. The face/sole integrated part 11 is formed by integrating the hosel section 9, the face section 2 and the sole section 4 of the golf club head 1 while the crown part 12 is formed by integrating the crown section 3 and the side section 8. The face/sole integrated part 11 and the crown part 12 are integrated by bonding together through a joining section 13.

Figure 4:
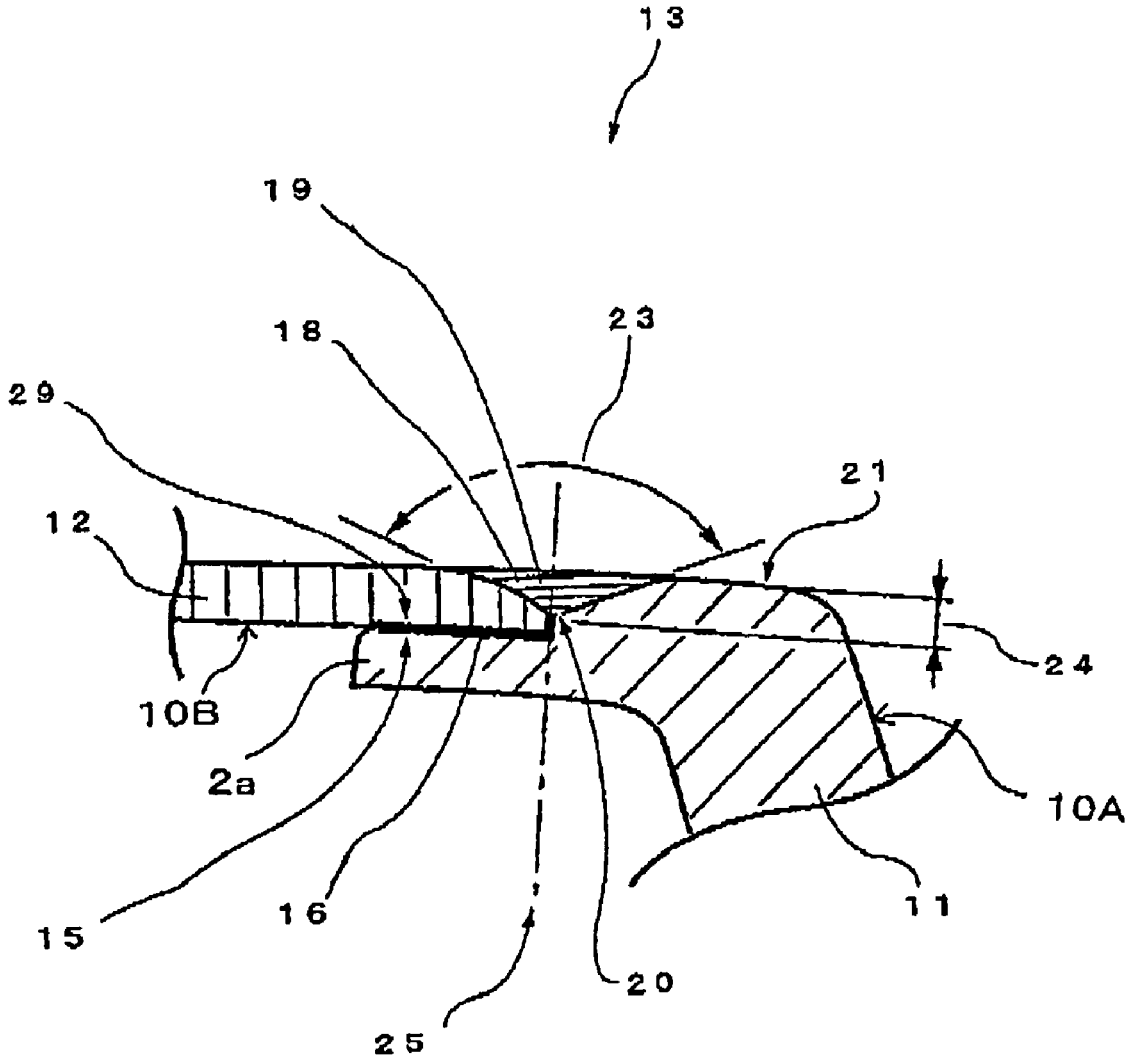
FIG. 4 is an enlarged view of major sections of the golf club head according to the embodiment of the present invention.

As for the structure of the joining section 13 of the golf club head 1 of this embodiment, as shown in FIGS. 3, 4, adhesive agent 16 is sandwiched between a joining face 15 formed on the face/sole integrated part 11 and a joining face 29 formed on the crown part 12 and both the parts are joined together. Then, a groove 18 is provided entirely over a joint border line 25 which is a center line of the border between both the parts exposed on the outer surface of the golf club head 1 at the time of the joining such that it is spread toward the outer surface and the aforementioned groove 18 is filled with joint material which is made of fiber reinforced resin material. Therefore, the joint material 19 is embedded over both the face/sole integrated part 11 (head main body 10A) and the crown part 12 (surface material 10B) with respect to the joint border line 25 as the center. In the golf club head 1 having the above-described structure, respective outer surfaces of the face/sole integrated part 11, the crown part 12 and the joint material 19 compose the outer surface of the golf club head 1 so that a smooth curved face is formed entirely on the surface of the golf club head 1.

The lateral sectional shape of the groove 18 is preferred to be formed in a substantially V-shaped or U-shaped configuration such that it is spread from a bottom portion 20 of the groove 18 toward the outer surface 21 of the golf club head 1, however, the lateral sectional shape may be formed in a square one as shown FIG. 4. Although the width and depth of the groove 18 are selected appropriately depending on the characteristic and thickness of the members, as its spreading angle 23, which is presented when the groove is formed in the substantially V-shaped or U-shaped configuration in its sectional view, is increased, an effect of preventing a deviation or gap in the joining section 13 by the application of the joint material 19 made of fiber reinforced resin material can be intensified more. Particularly because the joining area between the head main body 10A and the surface material 10B is expanded as the depth 24 of the groove 18 is decreased when the angle 23 is increased, the coupling force between both the members can be intensified.

Figure 9:
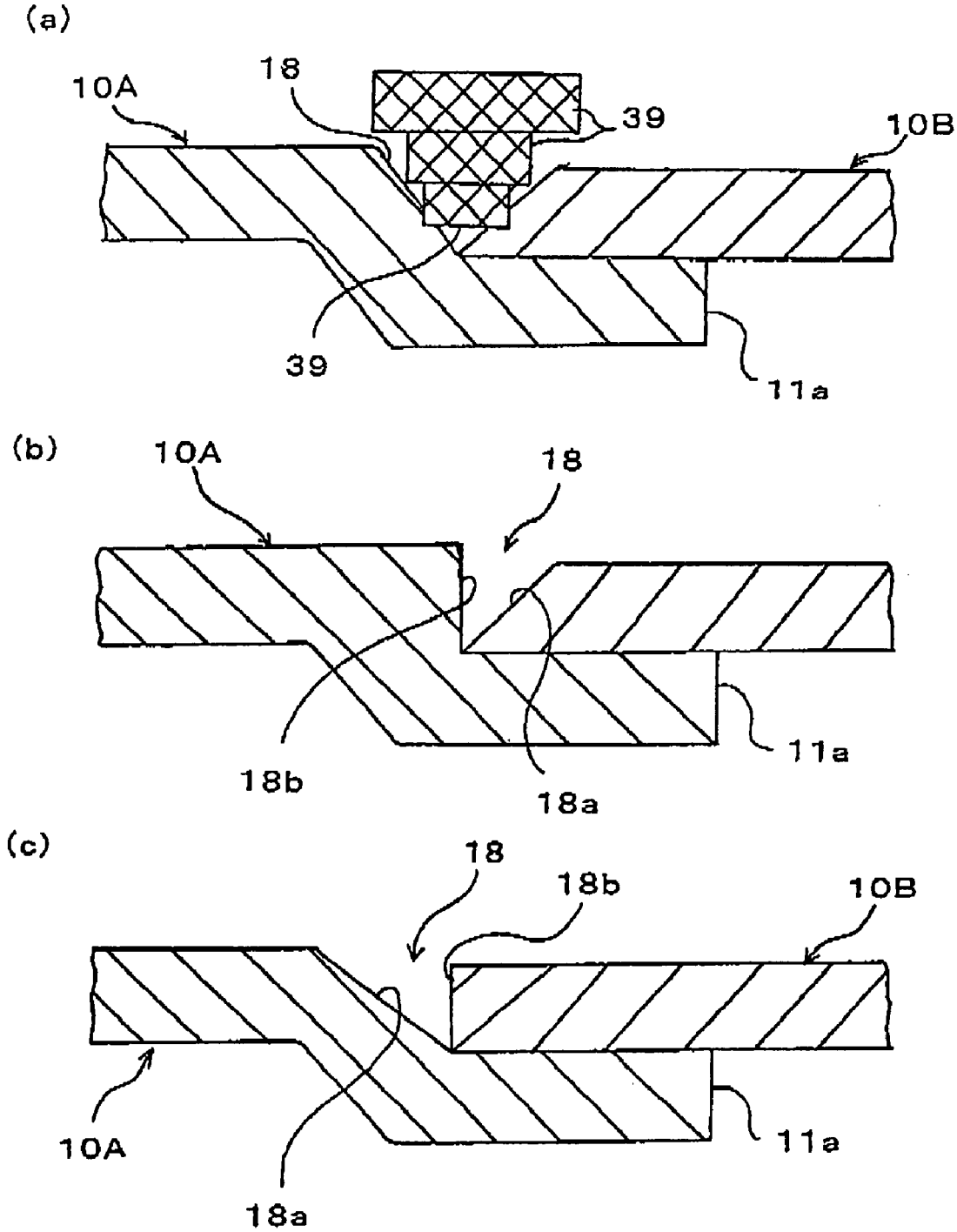
FIG. 9 is a diagram showing the state of the joining section between the head main body and surface material, FIG. 9(*a*) is a partially enlarged sectional view in case where a joint material composed of three layers is disposed, FIG. 9(*b*) is a partially enlarged sectional view showing other example of the groove configuration and FIG. 9(*c*) is a partially enlarged sectional view showing still another groove configuration.
Figure 10:
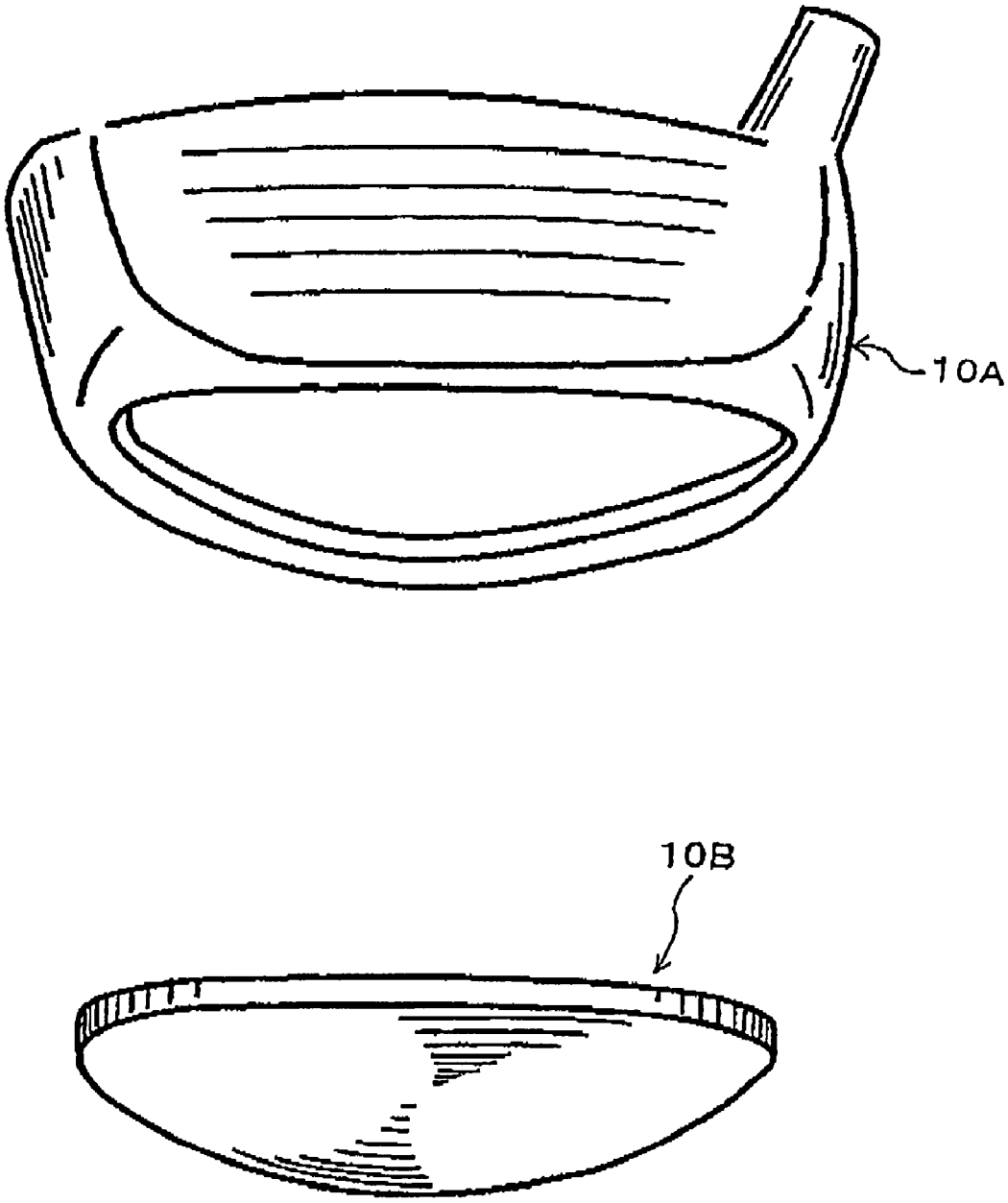
FIG. 10 is an explanatory diagram showing other embodiment.
Figure 11:
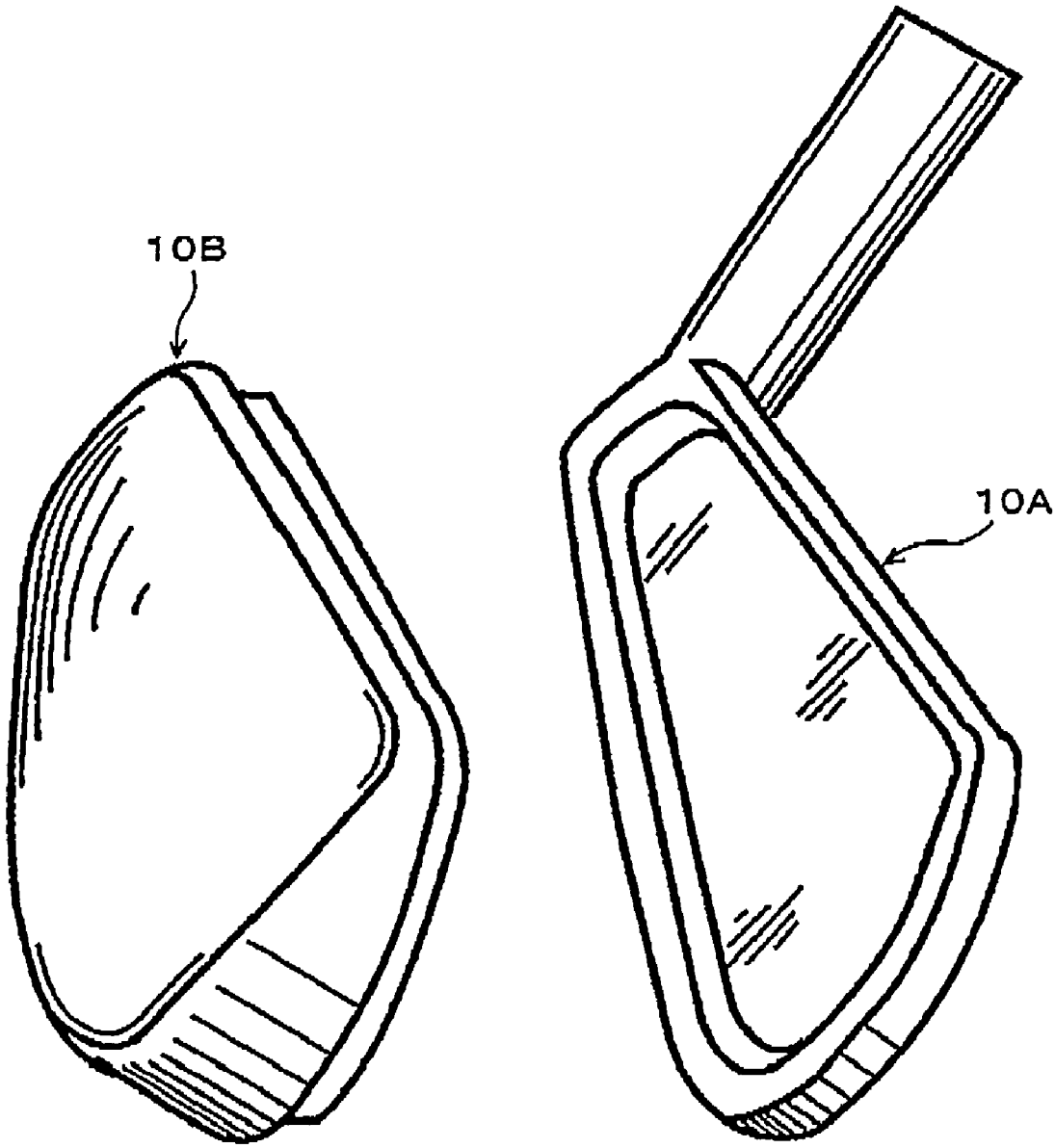
FIG. 11 is an explanatory diagram showing other embodiment.
Figure 12:
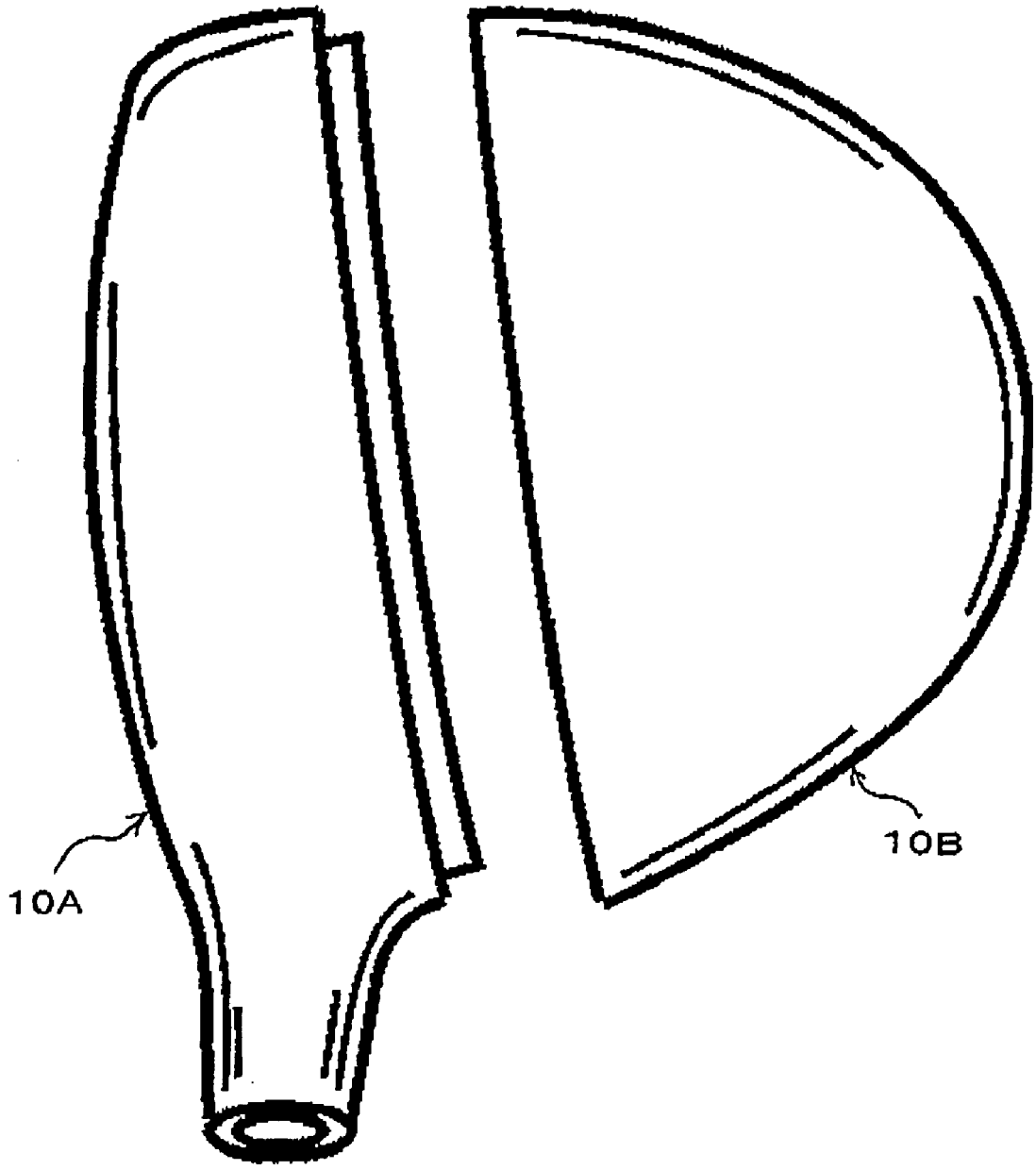
FIG. 12 is an explanatory diagram showing other embodiment.

The area where this groove is to be formed may be on the entire periphery of the joining section between the head main body 10A and the surface material 10B or on part thereof. That is, this groove 18 does not need to be formed on the entire periphery of the joining section, namely on the entire periphery of the surface material 10B as shown in FIG. 9. The reason is that most cracks or separations which occur in this kind of the golf club are concentrated to an area near the face section 2 on which an impact when a golf ball is hit is likely applied. Thus, the groove 18 may be formed on the area near the face section 2.

Figure 5:
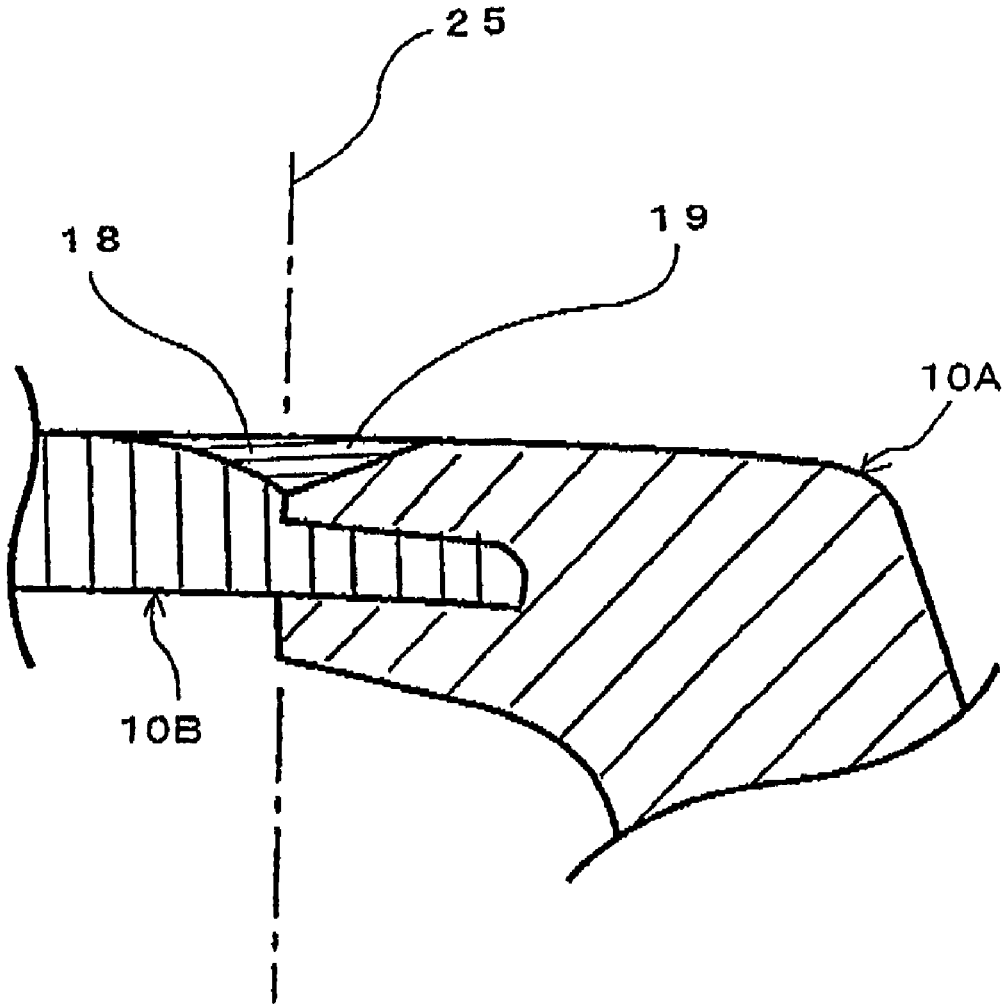
FIG. 5 is an explanatory diagram showing other embodiment.
Figure 6:
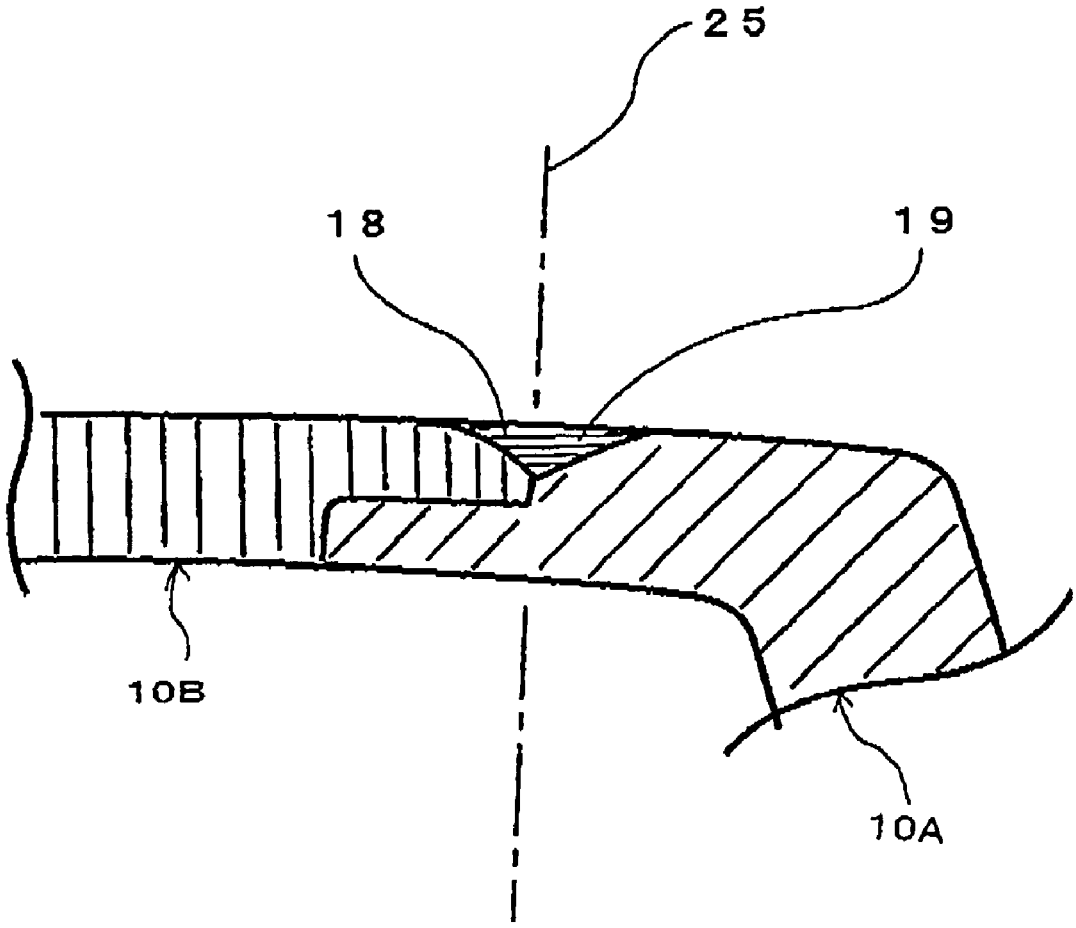
FIG. 6 is an explanatory diagram showing other embodiment.
Figure 7:
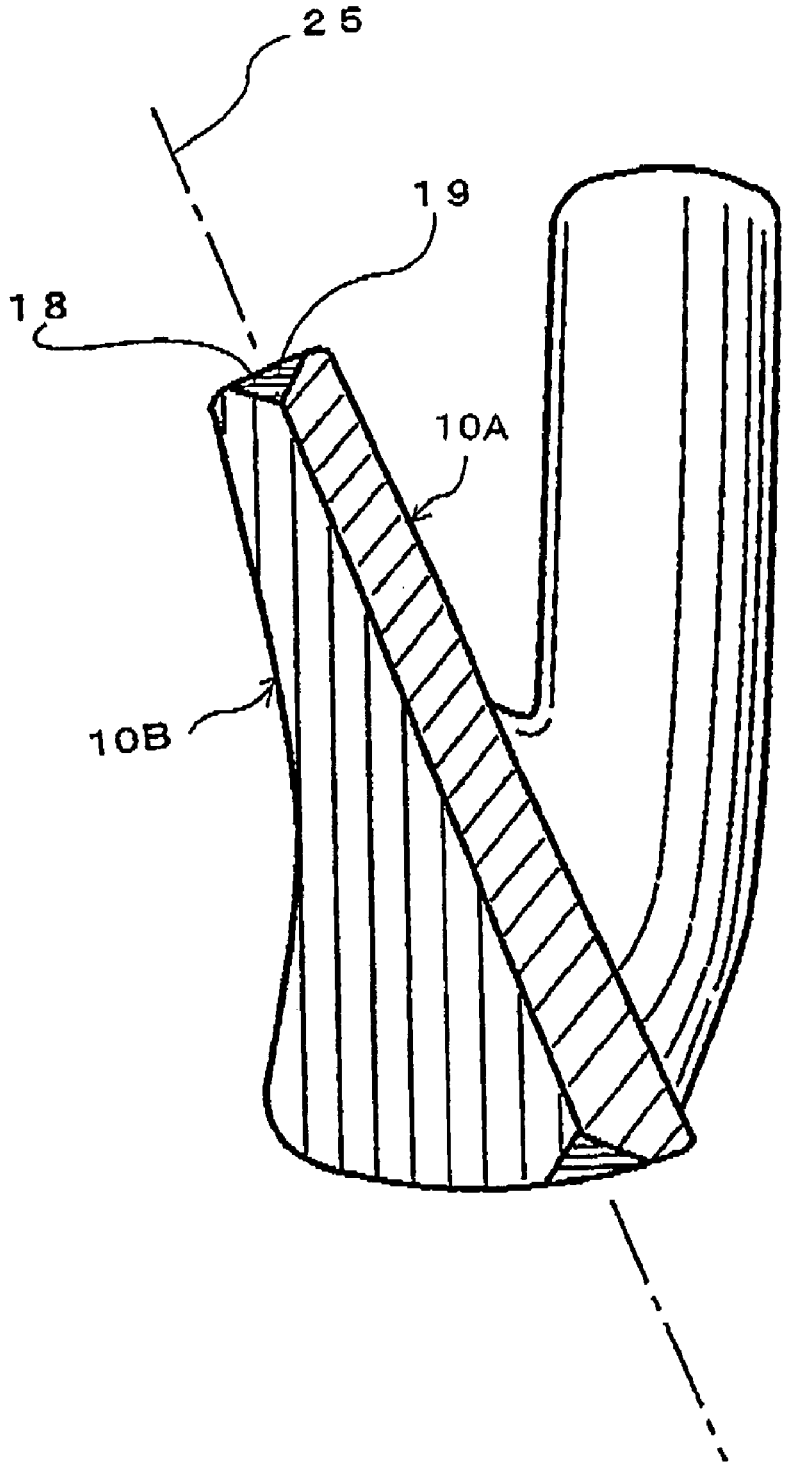
FIG. 7 is an explanatory diagram showing other embodiment.
Figure 8:
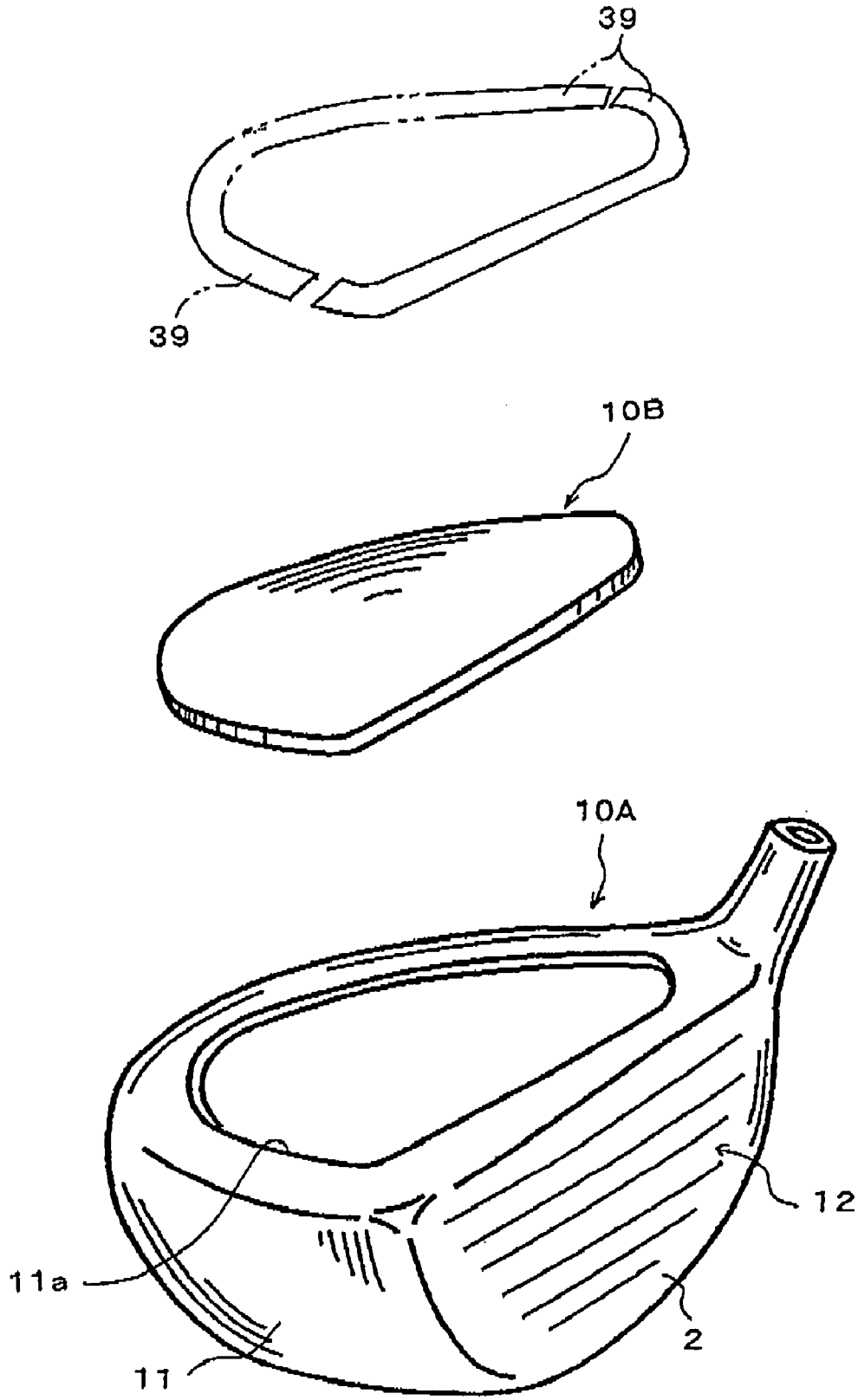
FIG. 8 is an explanatory diagram showing other embodiment.

The structure of the joining section 13 between the head main body 10A and the surface material 10B is not restricted to the above-described structure. The necessary structure is that, whatever the joining structure between the both members is as shown in FIGS. 5, 6, 7, the groove 18 formed such that it is spread toward the outer surface of the golf club head in its lateral sectional view, is provided entirely over the joint border line and the joint material 19 made of fiber reinforced resin material is embedded in that groove 18.

Further, the golf club head of the present invention is not restricted to the separation construction of the head main body 10A and the surface material 10B described in the above described embodiment. The present invention can be applied to the joining section of both members in any separation construction if the golf club head is produced by joining the head main body 10A with the surface material 10B together. FIGS. 9, 10, 11 and 12 exemplify the other separation constructions.

Although the golf club head of the present invention is so constructed by joining the head main body 10A and the surface material 10B with adhesive agent applied to the joining faces of the both members, it is permissible to dispose uncured material for the head main body 10A and surface material 10B within a molding die and then join both the materials by integral molding at the same time when fiber reinforced resin material is hardened. In this case, matrix resin in the fiber reinforced resin material substitute the role of the adhesive agent so as to achieve the integral formation.

As the reinforced fiber used for the joint material 19, metallic fiber, glass fiber, ceramic base fiber, organic base fiber, alumina fiber, boron fiber, titanium potassium fiber, carbon fiber and/or fiber and fabric composed of these mixtures may be used. Particularly, carbon fiber is preferable to reduce an increase in mass of the golf club head because it is light.

Although as the matrix resin used for the joint material 19, thermoplastic resin is used as well as thermosetting resin selectable from epoxy resin, unsaturated polyester resin, phenol resin, silicone resin, polyurethane resin, urea resin and the like, the heat curing resin is preferably used from viewpoint of easiness in its winding work in uncured state and stability in physical property after hardening.

The heat curing resin can be produced by mixing matrix resin of the joint material 39 composed of fiber reinforced resin material with fine carbon fiber as reinforced material. The fine carbon fiber is generated according to vapor grown method, laser aberration method, plasma synthesis method and the like and is formed under single layer structure in which its carbon hexagon net plane crystal is wound cylindrically or multiple-layer structure while a fine hollow sections exist in the center thereof. For example, carbon nano tube or carbon nano fiber and the like having an nano-order fiber diameter are available. In the meantime, as this fine carbon fiber, fullerene-nanotube having a different crystal structure may be used.

The fine carbon fiber is a light-weight fine fiber having an excellent specific strength, which serves as a filler for reinforcement when this is mixed in matrix resin of the joint material 39, so that the shearing strength of the joint material 39 is improved remarkably and additionally, its compressive strength is improved largely.

The average fiber diameter of each of these fine carbon fibers adopted is in a range of 10–300 nm, particularly in a range of 20–200 nm. The reason why the average fiber diameter of this fine carbon fiber is less than 300 nm is that if the diameter is larger than this value, the reinforcement effect of the matrix resin cannot be exerted sufficiently, so that a satisfactory compressive strength as a golf club head cannot be obtained and its heat conductivity drops so that an excellent vibration damping property cannot be exerted. The reason why the average fiber diameter of this fine carbon fiber is more than 20 nm is that if the diameter is smaller than this value, this fiber is difficult to handle, so that it cannot be mixed in matrix resin uniformly, thereby possibly causing deviation in the quality of the golf club head. Then, the average fiber length of the adopted fine carbon fiber is in a range of 2–30 nm, particularly in a range of 5–20 nm.

Preferably, this fine carbon fiber is mixed in matrix resin whose viscosity under an ambient temperature is set to 5–1000 cps, at a rate of 3–7 weight % in terms of 1–10 weight %. The reason why the mixing rate of this fine carbon fiber is set to more than 1 weight % is that if this mixing rate is smaller this value, the reinforcement effect of the matrix resin layer cannot be exerted sufficiently so that a satisfactory compressive strength as a golf club head cannot be obtained and its vibration damping property and repulsive property cannot be increased sufficiently. The reason why the mixing rate of this fine carbon fiber is set to less than 10 weight % is that if the mixing rate is larger than this value, the fiber is difficult to mix in the matrix resin uniformly and further even if more fine carbon fiber than 10 weight % is used, no excellent evaluation can be obtained in compressive strength, vibration damping property, repulsive property and the like.

Following effects are obtained from the above-described embodiments. In the golf club head produced by integrally joining the head main body and the surface material according to the present invention, the groove is formed partly or entirely over the joint border line in the joining section between the both members such that its lateral section is spread toward the outer surface of the golf club head and the groove is filled with joint material composed of fiber reinforced resin material, the joint material is constructed across the joint border line. As a result, in addition to a coupling force between the both members by bonding with ordinary adhesive agent, the coupling force between the both members can be intensified. Further, there is obtained an effect of relaxing impact or vibration due to a strike of the golf club head thereby preventing deviation and gap from occurring in the joining section.

The orientation angle of the reinforced fiber in the joint material 19 embedded in the groove 18 is preferred to be perpendicular to the joint border line 25 exposed in the joining section 13. That is, by orienting the reinforced fibers across the joint border line 25, strength holding force of the reinforced fiber in the joint material 19 intensifies the coupling force between both the face/sole integrated part 11 and the crown part 12, thereby preventing a deviation or gap which may occur in the joining section 13.

If the orientation angle is made in the same direction as the direction of the joint border line 25, a gap which may occur in the direction of the joint border line 25 is propagated between the reinforced fibers in the joint material 19, thereby causing a crevice in the joint material 19, which is not preferable.

Regarding the orientation angle of the reinforced fibers, it is preferable to intersect them in a range of 15° to 90° with respect to the joint border line 25. Consequently, the joint material 19 is capable of holding a coupling force between the joint material 19 and the both parts against impact and vibration in any direction generated in the golf club head.

If the orientation angle is set at right angle (90°) with respect to the joint border line 25, the reinforced fibers in the joint material 19 can be oriented at the largest angle to a stream-like gap generated in the joining section 13, so that the coupling force between the joint material 19 and the both parts can be intensified most. If the orientation angle is less than 15°, a gap generated in the direction of the joint border line 25 is propagated between the reinforced fibers in the joint material 19 like the above described case where it is in the same direction as that of the joint border line 25 so that a gap generated in the direction of the joint border line 25 is propagated between the reinforced fibers in the joint material 19 thereby generating a crevice, which is not preferable.

As regards the embedding style of the joint material 19 in the groove 18, it is preferable to impregnate the reinforced fibers arranged in parallel with the matrix resin into a prepreg state and cut them into belt-like pieces to tapes and overlay those tapes into multiple-layer structure. That is, by overlaying the multi-layers of the reinforced fibers, the strength of the joint material 19 and the coupling force between the face/sole integrated part 11 and the crown part 12 can be further improved.

The orientation angles of the reinforced fibers in the joint material 19 composed by overlaying the multiple layers of the material may be all in the same direction in respective overlaid layers or may be changed appropriately for each layer. It is preferable to arrange all the orientation angles in the same direction. That is, if any intersections of the reinforced fibers among respective layers is eliminated, not only the fitness between the reinforced fiber and matrix resin in each layer is intensified but also the binding force between the respective layers is intensified. Therefore, an effect of preventing a crevice or interlayer separation which may occur between layers in the joint material 19 can be further obtained.

Figure 13:
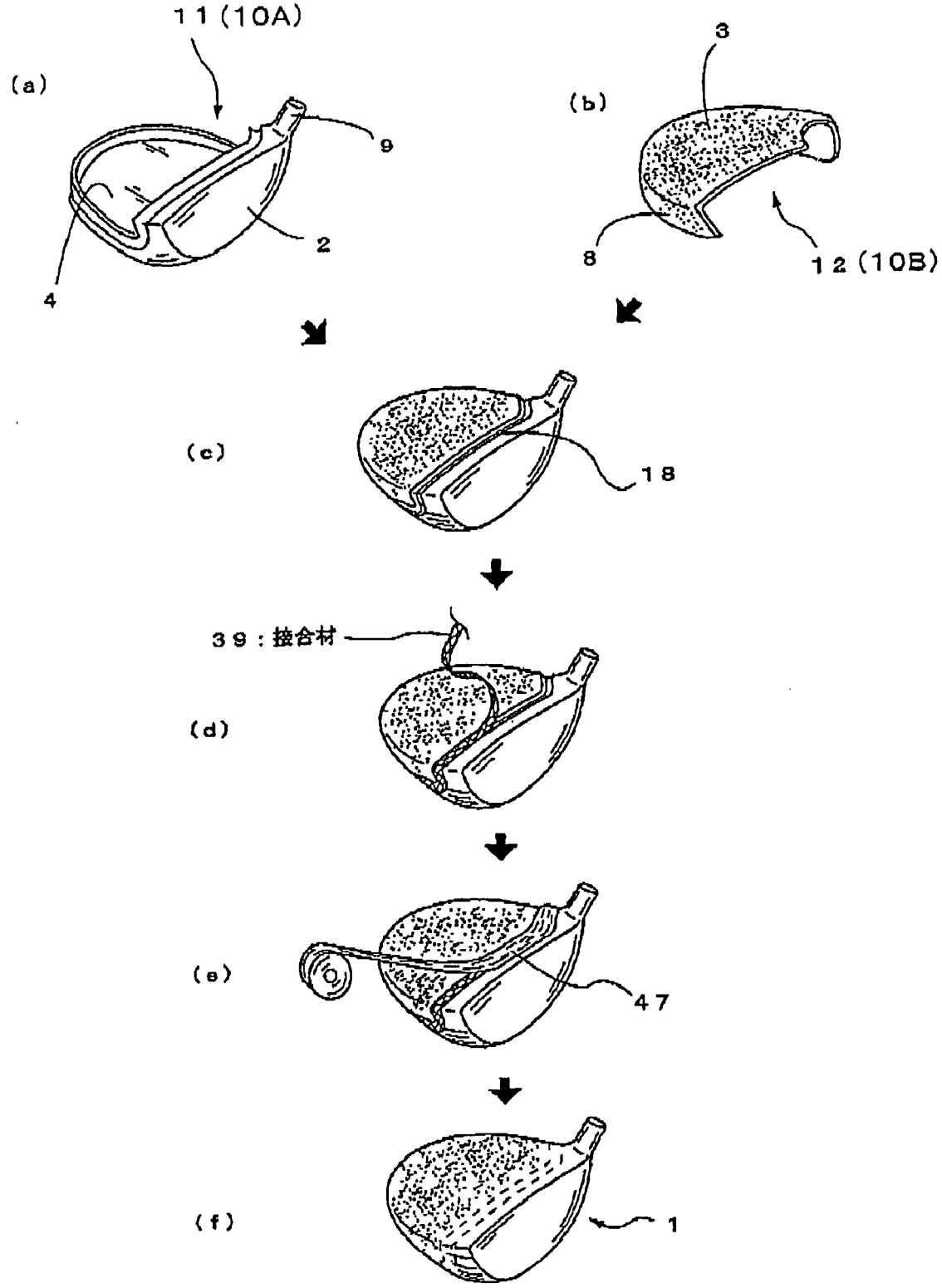
FIG. 13 is a perspective view showing manufacturing process according to an embodiment of the present invention.
Figure 14:
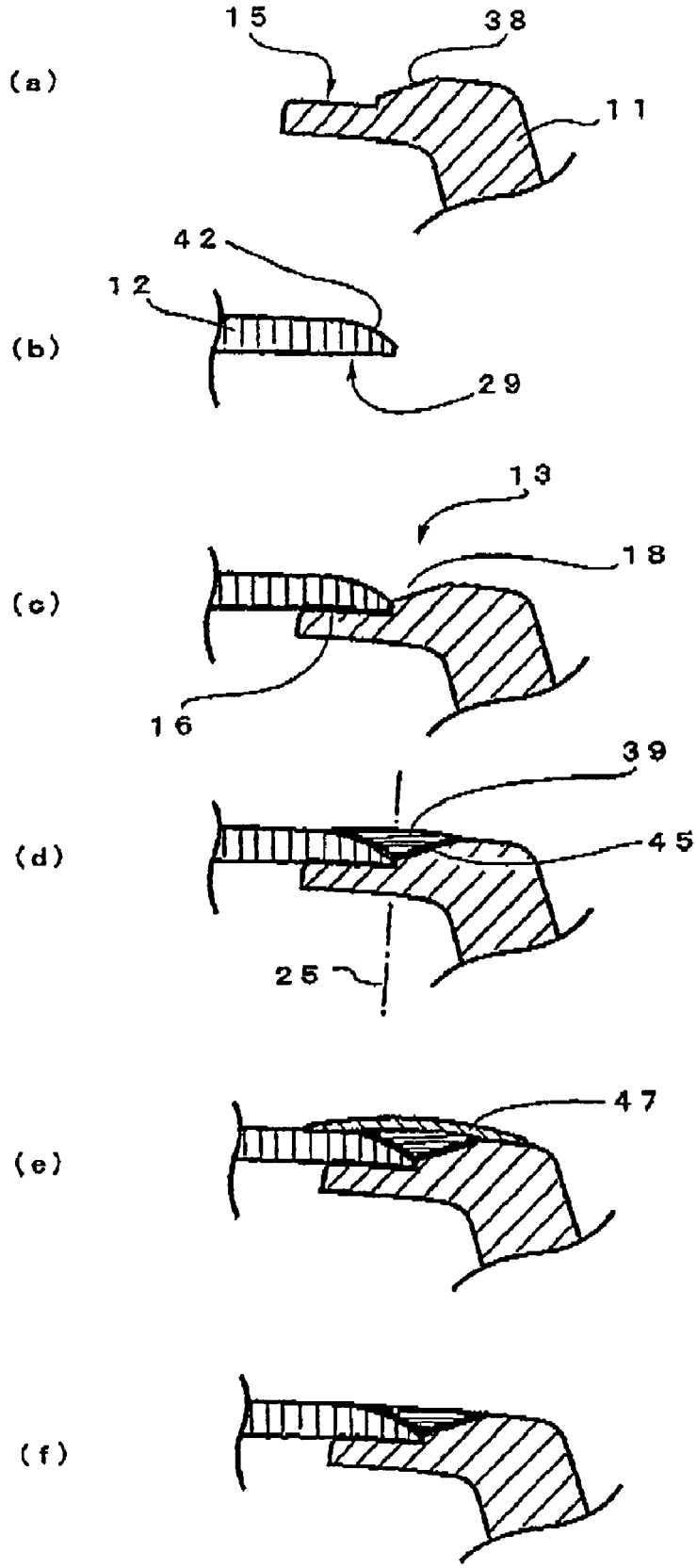
FIG. 14 is an enlarged view of major sections indicating the state of a joined section in each step of the manufacturing method according to the embodiment of the present invention.

Next, an embodiment of the manufacturing method of the golf club head of the present invention will be described as an example, with reference to FIG. 13(*a*), (*b*), (*c*), (*d*), (*e*), (*f*) and FIG. 14(*a*), (*b*), (*c*), (*d*), (*e*), (*f*). FIG. 13 shows steps of the manufacturing method of this embodiment through a perspective view. FIG. 14 is an enlarged diagram of major parts showing the state of a joining section in each step.

As shown in FIG. 13(*a*), a desired metallic material is prepared and then, a face/sole integrated part 11 (head main body 10A) in which the hosel section 9, the face section 2 and the sole section 4 are formed integrally is obtained by a forming method selected appropriately from cutting, pressing, forging and casting by a machine tool. At this time, a joining face 15 is formed on a peripheral edge which is to be joined to the crown part 12, of the face/sole integrated part 11 as shown in FIG. 14(*a*). Further, an oblique wall 38 is provided to construct one side of the groove 18 which is to be formed when the crown part 12 is joined to the joining face 15. Alternatively, the inside of the joining face 15 of the head main body 10A may be extended as shown in FIG. 4 and this section is used as a receiving section 2*a*. This receiving section 2*a* receives the surface material 10B to enable a work for joining the joining face 15 to the head main body 10A to be carried out stably.

On the other hand, as shown FIG. 13(*b*), the crown part 12, in which the crown section 3 and the side section 8 are formed integrally, is obtained according to a forming method of the fiber reinforced resin material appropriately selected from a method that a prepreg body produced by impregnating the reinforced fibers with matrix resin in uncured condition is disposed within a predetermined molding die and after that, the prepreg body is hardened by heat treatment into a desired configuration, a method that reinforced fibers are disposed within the molding die preliminarily and the matrix resin is poured into the molding die and hardened into a desired configuration and other methods.

At this time, the joining face 29, which is to be joined to the face/sole integrated part 11, is formed on the crown part 12 and further, an oblique wall 42, which constitutes one side of the groove 18 when the face/sole integrated part 11 is joined to the joining face 29, is provided adjacent to the joining face 29, as shown in FIG. 14(*b*).

Next, the adhesive agent 16 is applied to the joining faces 15, 29 of the face/sole integrated part 11 and the crown part 12 as shown in FIGS. 13(*c*) and 14(*c*) and after that, the joining faces 15, 29 are brought into a contact with each other across the adhesive agent 16 and by hardening the adhesive agent 16, joining of the both parts is completed.

Thus, the groove 18 is formed in the joining section 13 of the golf club head by the oblique walls 38, 42, which are formed on the both parts preliminarily when the joining is completed. The groove 18 is provided entirely on the outer periphery of the joining section 13 and the lateral sectional shape of the groove 18 is spread toward the outer surface of the golf club head.

Although according to the method of this embodiment, the groove 18 is constructed by first forming the oblique walls 38, 42 adjacent to the joining faces 15, 29 in the face/sole integrated part 11 and the crown part 12 and the groove 18 is consequently formed after the joining faces 15, 29 of the both parts are joined together, it is permissible to form it by cutting, grinding, polishing by a machine tool or by manual treatment.

After that, as shown in FIGS. 13(*d*) and 14(*d*), the adhesive agent 45 is applied to the groove 18 and then, the joint material 39 is disposed on the adhesive agent 45.

Figure 17:
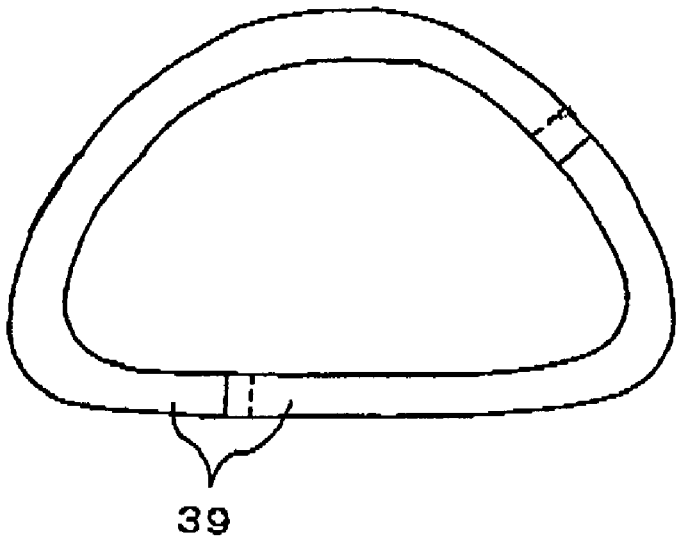
FIG. 17 is a plan view showing the cutting condition of the joint material and indicating two kinds (a) and (b)
Figure 17:
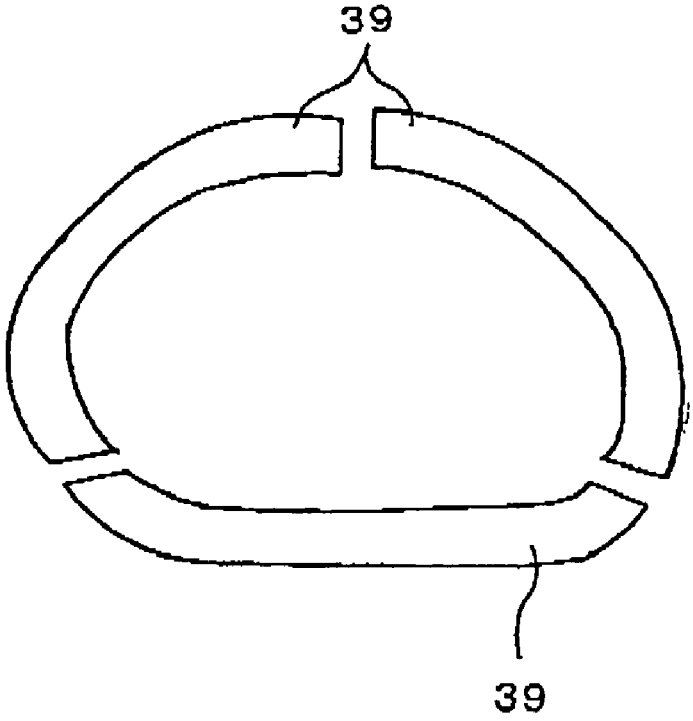

According to this embodiment, the joint material 39, which is in the prepreg state by impregnating the arranged reinforced fibers with the matrix resin, is cut to a belt-like piece such that the reinforced fibers are oriented at a predetermined angle (at right angle or obliquely) with respect to the length direction of the joint material 39 into the form of a tape. Thus, this joint material 39 is wound on the adhesive agent 45. In this case, the tape-like joint material 39 should be cut into the length and configuration shown in FIGS. 17(*a*) or (*b*) and disposed on the opening section of the head main body 10A such that respective end sections overlap by about 5 mm. Although the number of the division may be two as shown in FIG. 17(*a*) or three as shown in FIG. 17(*b*), that number is determined appropriately.

Because the method of winding the tape-like joint material 39 is used, the winding work of the joint material 39 can be carried out with a single joint material 39 and multiple layers can be formed therewith. Consequently, the winding work is facilitated and its work efficiency is improved. Further because the joint material 39 is disposed such that the orientation angle of the reinforced fibers in the joint material 39 intersects with the joint border line 25 exposed on the joining section 13, the binding force for the joint material 39 and the both parts is intensified by strength holding force of the reinforced fibers in the joint material 39 as well as the joint material 39 and the face/sole integrated part 11 and the joint material 39 and the crown part 12 are joined together by the bonding force of the adhesive agent 45, thereby preventing deviation or gap which may be generated by the joining section 13.

By winding the joint material 39 not in a single layer but overlappingly as shown in FIG. 9(*a*), both the strength of the joint material 39 after the hardening and the coupling force between the face/sole integrated part 11 and crown part 12 can be intensified.

Although improvement of the coupling force between the joint material 39 and the both parts is possible by depending on only the binding force of the matrix resin in the joint material 39 made of fiber reinforced resin material without using the adhesive agent 45, it is preferable to coat with the adhesive agent 45 preliminarily to obtain a strong binding force by filling the entire groove 18.

If the orientation angle of the reinforced fibers in the joint material 39 is set at right angle (90°) to the length direction of the joint material 39, it comes that the reinforced fibers in the joint material 39 after the winding are located at the largest angle with respect to stream-like gap which may be generated on the joint border line and consequently, the binding force between the joint material 39 and the both parts can be increased to the highest level.

If the orientation angle is set oblique to the length direction of the joint material 39, the joint material 39 after the winding is capable of holding the binding force between the joint material 39 and the both parts against impacts and vibrations in any direction which occur in the gold club head. Further, because plasticity can be secured in the joint material 39 in uncured condition, the winding operation is facilitated.

If the orientation angle is in parallel to the length direction of the joint material 39, the orientation angle of the joint material after the winding becomes equal to the direction of the joint border line 25. Consequently, a gap generated on the joint border line 25 is propagated in between the reinforced fibers in the joint material 39, so that crevices occur in the joint material 39, which is not preferable.

The orientation angle of the reinforced fibers is preferred to be in a range of 15° to 90° with respect to the length direction of the joint material 39. If the orientation angle is less than 15°, the gap generated in the direction of the joint border line 25 is propagated in between the reinforced fibers in the joint material 39 like a case where it is in the same direction as the length direction of the joint material 39, so that crevices occur in the joint material 39, which is not preferable.

Next, a wrapping tape 47 is wound on the joint material 39 as a pressurizing means for pressurizing the joint material 39 as shown in FIGS. 13(*e*) and 14(*e*). By winding the wrapping tape 47, the adhesive agent 45 and the joint material 39 can be fit to the face/sole integrated part 11 and the crown part 12. Thus, gaps which may occur between the respective members can be eliminated, thereby making it possible to protect the golf club head from damage due to the aforementioned gap by repeated strikes.

If a wrapping tape 47 having a characteristic of being contracted due to heating is employed in case where the joint material 39 and the adhesive agent 45 have the characteristic of being hardened by heating, a pressure can be applied to the joint material 39 at the same time when the joint material 39 and the adhesive agent 45 are hardened by heat, thereby providing an excellent productivity.

The material of the wrapping tape 47 is selected appropriately from PVC resin, PET resin, polypropylene, olefin resin such as polyethylene resin, Teflon resin and the like.

As for the pressurizing method for the joint material 39, the adhesive agent 45 and joint material 39 can be fit to the face/sole integrated part 11 and the crown part 12 by a method of pressuring fluid such as gas, liquid in a pressure container as a pressuring means represented by an autoclave forming method as well as the method by winding the wrapping tape 47. Therefore, the gap which may occur between the respective members can be eliminated thereby protecting the golf club head from damage due to gap.

After the joint material 39 and the adhesive agent 45 are left to harden by a hardening means depending on the characteristic of the material such as heating, cooling and leaving under the ambient temperature as shown in FIGS. 13(*f*) and 14(*f*), the wrapping tape 47 is removed and a predetermined processing such as grinding, coating is carried out so as to obtain the golf club head 1.

According to the above-described production method, the coupling force of the joining section is improved and the deviation or gap can be prevented from occurring in the joining section by passing through a step of providing a groove spreading toward the outer surface of the golf club head on the entire periphery of the joining section between the head main body 10A and the surface material 10B, a step of disposing the joint material of the fiber reinforced resin material in the groove, and a step of pressuring the joint material by a pressuring means.

EXAMPLE 1

Figure 15:
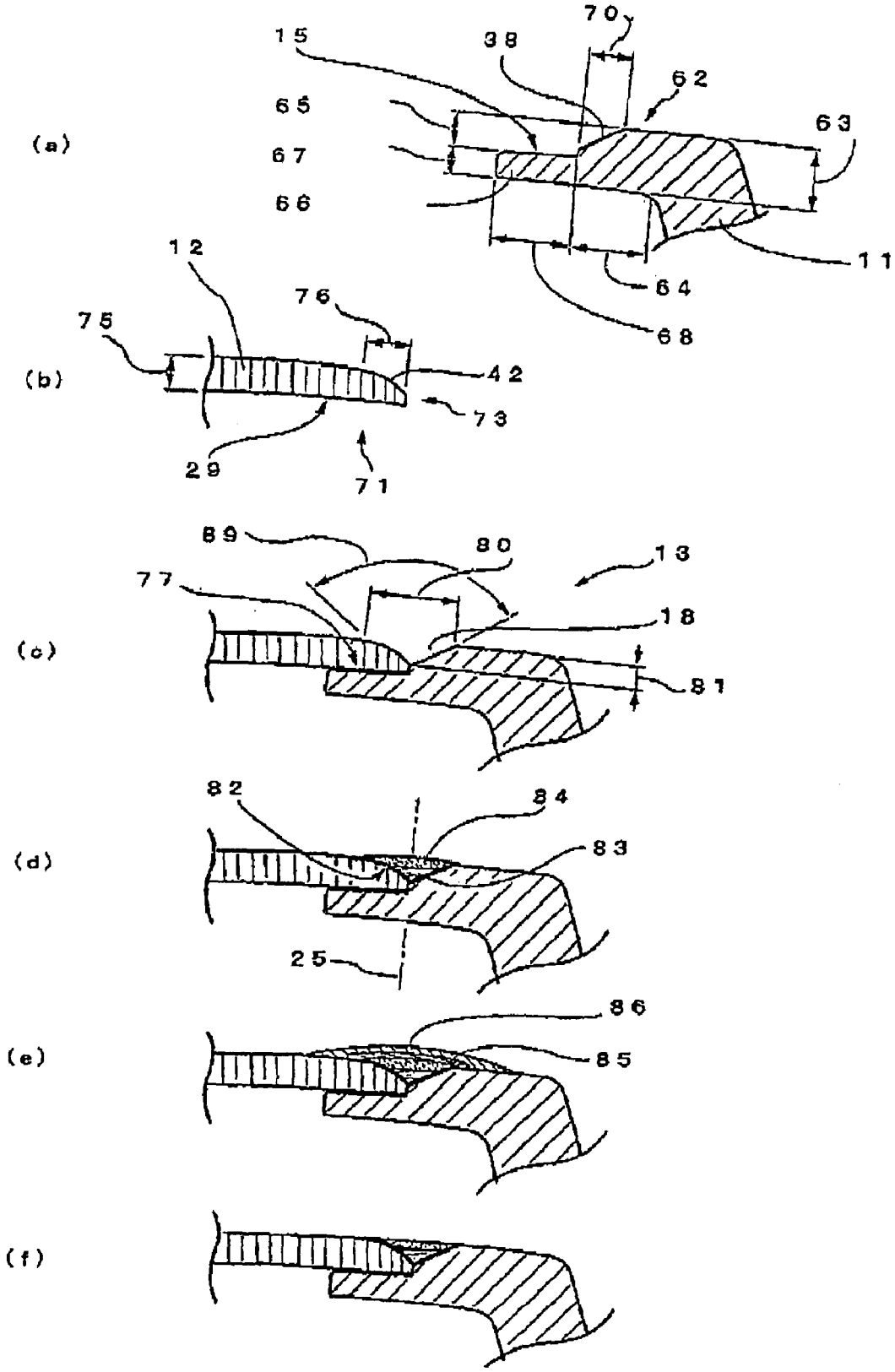
FIG. 15 is an enlarged view of major sections indicating the state of a joined section in each step of the manufacturing method of the embodiment.

An example of the golf club head of the present invention and the manufacturing method will be described with reference to the accompanying drawings. FIGS. 15(*a*), (*b*), (*c*), (*d*), (*e*) and (*f*) show the state of the manufacturing method of the golf club head according to this embodiment.

To manufacture the golf club head of this embodiment, a face/sole integrated part 11 is obtained using titan alloy (6% Al-4% V-remainder Ti) according to the lost-wax process. According to this embodiment, a jaw section 62, which constitutes parts of the crown section 3, the side section 8 and the sole section 4, is formed such that it is extended from the face section 2 (surface material 10B) in the face/sole integrated part 11 (head main body 10A).

At this time, as shown in FIG. 15(*a*), the wall thickness 63 of the jaw section 62 was 2 mm while the length of the extension was 10 mm. A step 65 having a thickness equal to the wall thickness of the crown part 12 is provided on the side of an outer surface of the face/sole integrated part 11 at a front end of the jaw section 62 while a joining section 66 is projected. The wall thickness 67 of the joining section 66 is 1 mm and the projection length 68 is 8 mm. According to this embodiment, the outer surface of the joining section 66 serves for the joining face 15 of the face/sole integrated part 11. Further, the oblique wall 38 is formed at the root of the joining section 66 by the step 65. The oblique wall 38 is formed such that the thickness 63 of the jaw section 62 is decreased gradually up to the wall thickness 67 of the joining section 66, so that substantially an inclined face is formed, thereby constructing a wall on one side of the groove 18 formed in the joining section 13 with the crown part 12 in subsequent steps. A horizontal width 70 of the oblique wall 38 was 3 mm.

On the other hand, the crown part 12 is formed with prepreg sheets in which carbon fibers are impregnated with heat curing epoxy resin in uncured condition. According to this embodiment, the joining face 29 is provided on the inside surface of an opening periphery 71 of the crown part 12 as shown in FIG. 15(*b*). The wall thickness 75 of the opening periphery 71 was 1 mm. Further, an end section 73 of the opening periphery 71 is provided with an oblique wall 42. The oblique wall 42 is formed as a substantially inclined face so that the thickness 75 is decreased gradually as it goes from the outer surface of the crown part 12 toward the inside surface, thereby constructing a wall on the other side of the groove 18 formed in the joining section 13 with the face/sole integrated part 11 in subsequent steps. The horizontal width 76 of the oblique wall 42 was 3 mm.

After epoxy resin base heat curing type adhesive agent is applied to the joining faces 15, 29 of the face/sole integrated part 11 and the crown part 12 as shown in FIG. 15(*c*), the joining face 15 and the joining face 29 are brought into a contact with each other and joined together temporarily. By heating the both parts joined temporarily in a heat curing furnace at about 140° C. for about an hour, the adhesive agent 77 is hardened to complete integration of the face/sole integrated part 11 and the crown part 12. At this time, the groove 18 is formed on the entire periphery of the joining section 13 between the face/sole integrated part 11 and the crown part 12. The lateral sectional shape of the groove 18 is substantially V shaped, while its groove width 80 is 6 mm, the depth 81 is 1 mm and the spreading angle 89 of the V shape is about 143°.

As shown in FIG. 15(*d*), after the epoxy base heat curing type adhesive agent 82 is applied to the surface of the groove 18, belt-like prepreg tapes 83, 84, which are produced by impregnating carbon fibers arranged in parallel as reinforced fibers with heat curing type epoxy resin as matrix resin, are prepared as the joint material and then, the prepreg tape 83 is wound on the adhesive agents 82 and finally, the prepreg tape 84 is wound on that.

The prepreg tape 83 is produced by overlaying two tapes each in which the orientation angle of the carbon fibers is at 90° with respect to the length direction of the prepreg tape 83, having the width of 5 mm and the thickness of 0.2 mm. The prepreg tape 84 is produced by overlaying two tapes each in which the orientation angle of the carbon fibers is at 45° with respect to the length direction of the prepreg tape 84 in a condition that the carbon fibers intersect with each other, having the width of 10 mm and the thickness of 0.35 mm. Therefore, the carbon fibers in the prepreg tapes 83, 84 are constructed across the joint border line 25.

Next, wrapping tape 85 having one side made of PVC resin and adhesiveness is wound on the prepreg tapes 83, 84 as shown in FIG. 15(*e*) and after that, wrapping tape 86 made of PET resin is wound.

By heating at about 140° C. for about an hour, the adhesive agent 82 and the prepreg tapes 83, 84 are hardened. Because at this time, the wrapping tapes 85, 86 are contracted by the heating, the prepreg tapes 83, 84 are hardened while tightened. After the hardening, the wrapping tapes 85, 86 are peeled and removed. Then, the surfaces of the face/sole integrated part 11, crown part 12 and hardened prepreg tape 84 are polished with a sand paper and painted so as to obtain the golf club head of this embodiment as shown in FIG. 15(*f*).

Figure 16:
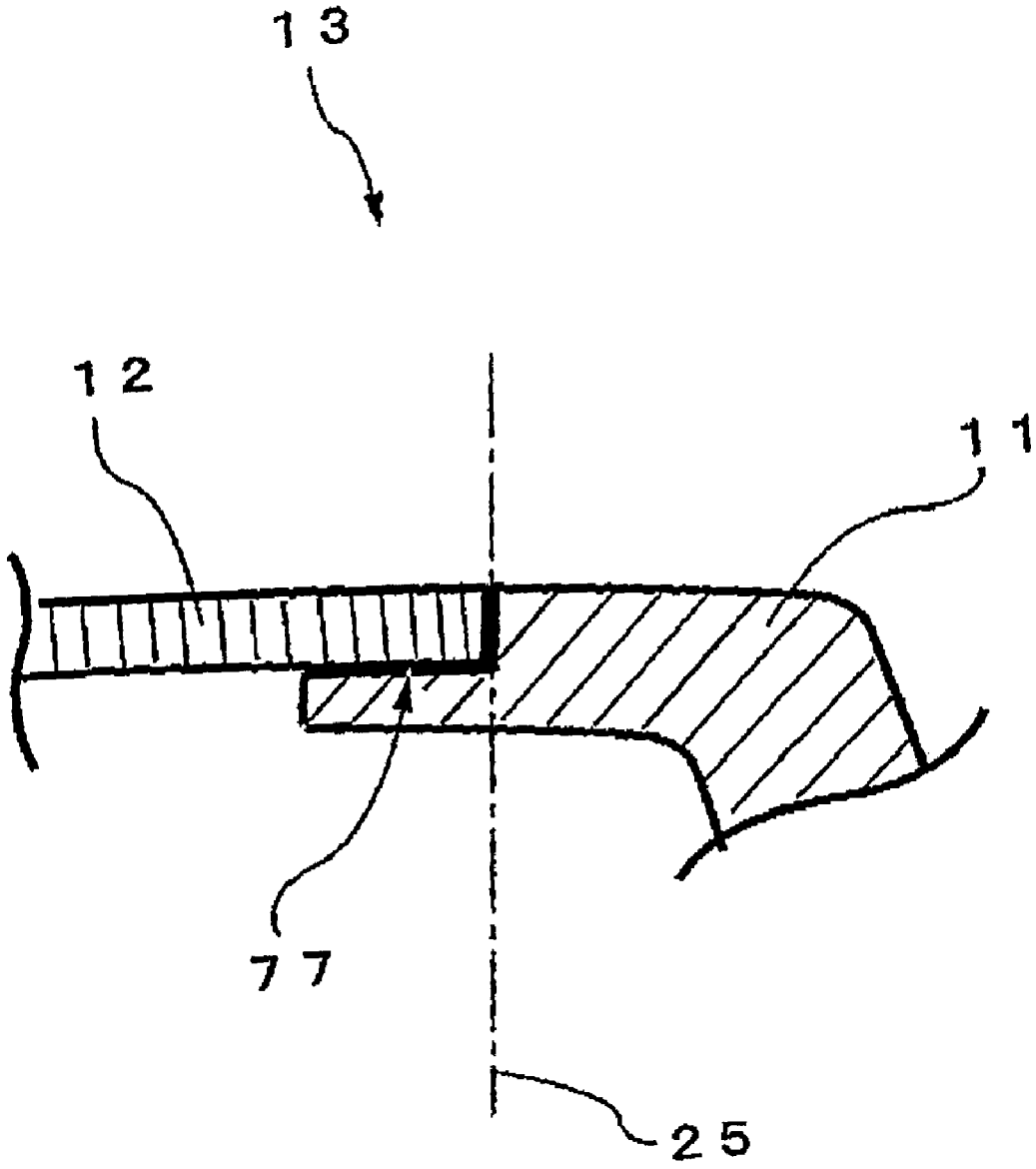
FIG. 16 is an enlarged view of major sections in a joined section of a golf club head of a comparative example.

A golf club head of comparative example is produced by joining the face/sole integrated part 11 and the main body part 12 with the adhesive agent 77 without constructing the groove 18 and prepreg tapes 83, 84 of the above-described embodiment and polishing and painting. FIG. 16 shows an enlarged view of major portions in the joining section 13 of the golf club head of the comparative example.

A durability test was made on the golf club head of this embodiment and the golf club head of the comparative example using a durability test machine which forces continuous strikes of ball to be made. The head speed was set to 45 m/s and with a strike position set at the face center, striking of ball was continued and each time a predetermined number of balls are hit, the joining section 13 between the face/sole integrated part 11 and the crown part 12 was checked for deviation, gap and crevice. This durability test was continued until the golf club head was destroyed. Table 1 shows the test result.

TABLE 1

| Number of balls | 500 | 1000 | 1500 | 2000 | -> | 10000 |
|---|---|---|---|---|---|---|
| This embodiment | ○ | ○ | ○ | ○ | -> | ○ |
| Comparative example | ○ | x | — | — | — | — |

○: No problem
x: Occurrence of crevice

As shown in Table 1, in case of the golf club head of the comparative example, a stream-like crevice was found along the joint border line 25 between the face/sole integrated part 11 and the crown part 12 when the 1000th ball was hit. In case of the golf club head of the embodiment, although hitting of a ball was continued further up to the 10000th ball, no crevice was generated and then the test was stopped.

Therefore, the golf club head of this embodiment can prevent occurrence of deviation, gap and crevices against repeated impacts by hitting, its durability is improved and high-quality is maintained.

EXAMPLE 2

FIG. 9 shows a head main body 10A and a surface material 10B which constitute a golf club according to the example 2 of the present invention. The head main body 10A and surface material 10B constitute the golf club of so-called driver.

The head main body 10A is composed of the above-described face/sole integrated part 11 made of metal and has a space inside while an opening 11*a* is formed in its top face. The surface material 10B is formed of fiber reinforced resin material using carbon fiber into a sheet-like part which can cover the opening 11*a* of the head main body 10A.

As for the head main body 10A and the surface material 10B, as shown in FIG. 9(*a*), while the groove 18 is formed in the joining section, the surface material 10B is bonded onto the opening 11*a* in the head main body 10A. To achieve excellent bonding, faces of the head main body 10A and surface material 10B to be bonded to each other are roughed by sand blasting. If the groove 18 is formed in the joining section between the head main body 10A and the surface material 10B, the joint material 39 is attached through adhesive agent 45 to fill this groove 18 and then, left to harden.

At this time, the groove 18 and the joint material 39 to fill the groove do not need to be formed on the entire periphery of the joining section, that is, entirely over the surface material 10B as shown in FIG. 9. The reason is that most cracks or separations generated in this kind of the golf club are concentrated on an area near the face section 2 on which an impact when a golf ball is hit is likely applied. Therefore, the groove 18 and the joint material 39 which fills this groove may be formed near the face section 2.

The joint material 39 for use in this embodiment is in the prepreg state in which the arranged reinforcement fibers are impregnated with matrix resin and formed by cutting into each belt to a tape-like configuration in which the reinforcement fibers are oriented at a predetermined angle (at right angle or obliquely) with the length direction of the joint material 39. This tape-like joint material 39 is cut to two pieces as shown in upper section of FIG. 9 and placed on the adhesive agent 45. At this time, as described previously, the joint material 39 indicated by two-dot and dash line in FIG. 9 may be omitted.

According to this embodiment, the joint materials 39 are laid in three layers as shown in FIG. 9(*a*). Of course, the width of the joint material 39 constituting each layer needs to agree with the configuration of the groove 18, for example, widths of 7 mm, 10 mm, 12 mm are used successively. Each of these joint materials 39 in comprised of carbon fiber layer at the bottommost layer, carbon fiber layer at the intermediate layer and glass fiber layer at the topmost layer and the orientation angles of the fibers at the respective layers are different.

The groove 18 needs to be formed on only a necessary section in the joining area between the head main body 10A and the surface material 10B. The groove 18 is not restricted to a configuration which is spread upward as shown in FIG. 9(*a*), but may be formed by the vertical face 18*a* of the head main body 10A and the oblique face 18*a* of the surface material 10B as shown in FIG. 9(*b*) or by the oblique face 18*a* of the head main body 10A and the vertical face 18*b* of the surface material 10B as shown in FIG. 9(*c*).

Each joint material 39, which is attached to the joining section through adhesive agent, is heated with a jig (135° C.) and pressed for 60 minutes so as to leave the joint material 39 to harden. Then, the surface is polished to obtain a predetermined golf club.

In the golf club head in which the head main body 10A and surface material 10B are integrally joined, a groove is provided on at least part of the joint border line in the joining section between the both members such that its lateral section is spread toward the outer surface of the golf club head and joint material composed of fiber reinforced resin material is embedded in the groove. Consequently, the joint material is constructed across the joint border line, so that the coupling force between the both members can be intensified as compared to a coupling force presented by bonding with ordinary adhesive agent. Further, an effect of relaxing impact and vibration due to striking of the golf club head can be obtained. As a result, occurrence of deviation and gap in the joining section can be prevented, thereby providing a high-quality golf club head.

In the manufacturing method of a golf club head in which the head main body 10A and surface material 10B are integrally joined, the golf club head is manufactured through a step of providing the groove on at least part of the joining section between the head main body 10A and surface material 10B such that it spreads toward the outer surface of the golf club head, a step of disposing the joint material composed of fiber reinforced resin material in the groove and a step of pressurizing the joint material by a pressurizing means. Consequently, there is obtained a golf club head in which the coupling force of the joining section is improved and occurrence of the deviation and gap in the joining section is prevented. Thus, improvement in durability of the golf club head can be achieved.

What is claimed is:

1. A wood-type golf club head comprising:

a sole;

a striking plate;

a side section extending rearward of the striking plate and having toe, rear, and heel regions;

a top portion having an upper opening formed therein;

a shoulder disposed around a periphery of the upper opening;

a ledge extending from the shoulder towards a center portion of the upper opening;

a crown coupled to the ledge and having a side edge, wherein the side edge of the crown is disposed proximate to the shoulder; and a veil disposed between the side edge of the crown and the shoulder.

2. The golf club head of claim 1, wherein at least one of the side edge of the crown and the shoulder are tapered.

3. The golf club head of claim 1, wherein both the side edge of the crown and the shoulder are tapered.

4. The golf club head of claim 3, wherein the side edge of the crown and the shoulder define an angle greater than about 90 degrees and less than about 180 degrees.

5. The golf club head of claim 1, wherein the veil is comprised of a composite material.

6. The golf club head of claim 1, wherein the crown is comprised of a first material and the veil is comprised of a second material.

7. The golf club head of claim 6, wherein the first material is carbon fiber and the second material is glass.

8. The golf club head of claim 1, wherein the crown and the veil are comprised of the same material.

9. The golf club head of claim 1, wherein the veil covers an entire side edge of the crown.

10. A wood-type golf club head comprising:

a sole;

a striking plate;

a side section extending rearward of the striking plate and having toe, rear, and heel regions;

a top portion having an upper opening formed therein;

a shoulder disposed around a periphery of the upper opening;

a ledge extending from the shoulder towards a center portion of the upper opening;

a crown coupled to the ledge and having a side edge, wherein the side edge of the crown is disposed proximate to the shoulder, thereby forming an obtuse depression therebetween; and a means for filling at least a portion of the obtuse depression and preventing cracking and peeling of a club head surface layer.

* * * * *